US006896350B2

(12) United States Patent
Gomez et al.

(10) Patent No.: US 6,896,350 B2
(45) Date of Patent: May 24, 2005

(54) OPTIMIZED SERVICING THAT ADAPTS PREVENTATIVE AND CORRECTIVE ACTIONS TO THE LIFE OF A PRINTHEAD

(75) Inventors: Rosa Maria Gomez, Barcelona (ES); Jose Jurjo, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/998,799

(22) Filed: Oct. 31, 2001

(65) Prior Publication Data

US 2003/0081044 A1 May 1, 2003

(51) Int. Cl.[7] ..... B41J 2/165

(52) U.S. Cl. ..... 347/23; 347/35; 347/36; 347/19; 347/30

(58) Field of Search ..... 347/23, 19, 14

(56) References Cited

U.S. PATENT DOCUMENTS 5,455,608 A 10/1995 Stewart et al.
5,459,496 A * 10/1995 Hanabusa et al. ..... 347/5
6,161,913 A * 12/2000 Childers et al. ..... 347/19
6,234,472 B1 5/2001 Juan
6,361,138 B1 * 3/2002 Seino et al. ..... 347/19
6,431,680 B1 * 8/2002 Shinada ..... 347/19
6,536,865 B2 * 3/2003 Sarmast ..... 347/23

FOREIGN PATENT DOCUMENTS

EP 034935 * 9/2000

* cited by examiner

*Primary Examiner*—Stephen Meier
*Assistant Examiner*—Ly T Tran

(57) ABSTRACT

A method for determining service criteria for a printhead in a printer includes receiving an indication that service is needed, determining a calculated age of the printhead, and selecting a service procedure based on the determined calculated age. The selected service procedure has an impact on the long term life of the printhead that is proportional to the calculated age. The calculated age may be classified as a beginning of life phase, a middle of life phase or a maturity phase, and the service procedures may be selected such that the service procedure for the beginning of life phase has a low impact on the printhead's long term life, the service procedure for the middle of life phase has a moderate impact on the printhead's long term life, and the service procedure for the maturity phase has a severe impact on the printhead's long term life.

23 Claims, 11 Drawing Sheets

Z
Y
X
455
480
450
190
140
475
200
465
470
430
435
440
445
160
165
170
175
150
400
405
410
415
420
425
B
Y
M
C

OPTIMIZED SERVICING THAT ADAPTS PREVENTATIVE AND CORRECTIVE ACTIONS TO THE LIFE OF A PRINTHEAD

BACKGROUND OF THE INVENTION

1. Field of the Invention

The present invention relates to inkjet printing devices, and, in particular, to a method and apparatus for servicing a printhead.

2. Discussion of the Background Art

Inkjet printing mechanisms may be used in a variety of different printing devices, such as plotters, facsimile machines and inkjet printers, collectively referred to herein as printers. These printing mechanisms typically use a printhead to shoot drops of ink onto a page or sheet of print media. Some inkjet print mechanisms utilize a type of printhead called a cartridge that carries a self contained ink supply back and forth across the media. In the case of a multi-color cartridge, several printheads and reservoirs may be combined into a single unit. In this case, the multi-color cartridge is also referred to as a printhead.

Other inkjet print mechanisms, known as "off-axis" systems, propel only a small amount of ink in the printhead across the media, and include a main ink supply in a separate reservoir, which is located "off-axis" from the path of printhead travel. Typically, a flexible conduit or tubing is used to convey the ink from the reservoir to the printhead. A printhead may also have a cap or capping mechanism such that when the printhead is not printing, the printhead is covered. This may serve to prevent the printhead from drying and/or to otherwise protect the printhead from the environment.

Each printhead includes a series of nozzles through which the ink drops are fired. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett Packard Company. In a thermal ejection system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor.

To print an image, the printhead is scanned back and forth across above the media in an area known as a print zone, with the printhead expelling drops of ink as it travels. By selectively energizing the resistors as the printhead moves across the media, the ink is expelled in a pattern on the media to form a desired image (e.g., a picture, chart or text). The nozzles are typically arranged in one or more linear arrays. If more than one linear array is utilized, the linear arrays may be located side-by-side on the printhead, parallel to one another, and substantially perpendicular to the scanning direction. As such, the length of the nozzle arrays defines a print swath or band. That is, if all the nozzles of one array were continually fired as the printhead made one complete traverse through the print zone, a band or swath of ink would appear on the sheet. The height of this band is known as the "swath height" of the printhead, the maximum pattern of ink which can be laid down in a single pass.

The nozzle plate of the printhead may accumulate contaminants, such as fibers, dust, and the like, during the printing process. Such contaminants may adhere to the nozzle plate for various reasons including the presence of ink on the printhead, or because of electrostatic charges that may build up during operation. In addition, excess dried ink may accumulate around the printhead. The accumulation of ink or other contaminants may impair the quality of the output by interfering with the proper application of ink to the printing medium. Also, if color printheads are used, each printhead may have different nozzles which each expel different colors. If ink accumulates on the nozzle plate, a mixing of different colored inks, known as cross-contamination, can result during use. If colors are mixed on the nozzle plate, the quality of the resulting printed product can be affected. Another possible quality problem may result from particles that may form in the ink disposed in the reservoir, the tubing connecting the reservoir to the printhead, or within the printhead itself due to temperature, contamination, storage time, etc. Furthermore, the nozzles of an ink-jet printer can clog, particularly if the printheads are left uncapped for a period of time. For these reasons, it is desirable to service the printhead on a routine basis. Service procedures may include clearing the printhead nozzle plate of contaminants and ink on a routine basis to prevent the build up thereof. This may be accomplished by a service procedure where a printhead expels ink, is brought in contact with a wiper and expels ink again, also referred to as a spit-wipe-spit procedure, or more simply referred to as a wipe procedure. In some printers this wipe procedure is performed at the end of a print job based on certain criteria, for example, the number of drops fired since the last wipe procedure, the time a printhead has been uncapped, upon a user request, when power has first been applied to the printer, etc.

U.S. Pat. No. 5,455,608 describes how a printer may schedule a service procedure on a printhead based on the result of a drop detection step. Before starting a plot the printer performs a drop detection on all printheads present to detect if any nozzles are non-firing, also referred to as a "nozzle out" condition. If a nozzle out condition is detected in a printhead, the printer triggers an automatic process for servicing the malfunctioning printhead to clear or otherwise recover the malfunctioning nozzle.

This process includes a sequence of nozzle recovery procedures of increasing severity. At the end of each procedure a new drop detection test is performed on the printhead to detect if the printhead is fully recovered. If the drop detection test indicates that a nozzle out condition continues to exist, then another servicing procedure is performed. If, after a predetermined number of procedures, the printhead is still not fully recovered (i.e., at least one nozzle is still out), then the user is instructed to replace the printhead or to discontinue the current nozzle check. Thus, a "nozzle health" detection is performed before each print job and service procedures are performed based on a fixed threshold, in this example, at least one nozzle remaining non-functional.

Service procedures such as the wipe procedure are desirable to maintain print quality, but a disadvantage of these procedures is that they consume time and thus have a negative impact on printer throughput and printer productivity. It has been empirically determined that for some printers a servicing action lasting only one second may have a negative impact on throughput of about 2%. This has become more important over time as customers increasingly require shorter printing times and longer printing lengths. Another disadvantage of the service procedures is that they have a negative effect on the long term health of the printhead. For example, the wiping action has a tendency to degrade the nozzle plate by wearing, scratching and/or distorting the surface.

SUMMARY OF THE INVENTION

The present invention overcomes these disadvantages by providing a method and apparatus for performing service procedures on a printhead in a manner that has a reduced impact on printer throughput. This is accomplished by determining service criteria for a printhead in a printer, including receiving an indication that service is needed, determining a calculated age of the printhead, and selecting a service procedure based on the determined calculated age. The selected service procedure has an impact on the long term life of the printhead that is proportional to the calculated age. The calculated age may be classified as a beginning of life phase, a middle of life phase or a maturity phase, and the service procedures may be selected such that the service procedure for the beginning of life phase has a low impact on the printhead's long term life, the service procedure for the middle of life phase has a moderate impact on the printhead's long term life, and the service procedure for the maturity phase has a severe impact on the printhead's long term life.

BRIEF DESCRIPTION OF THE DRAWINGS

The above set forth and other features of the invention are made more apparent in the ensuing Detailed Description of the Invention when read in conjunction with the attached Drawings, wherein.

DETAILED DESCRIPTION OF THE INVENTION

Figure 1:
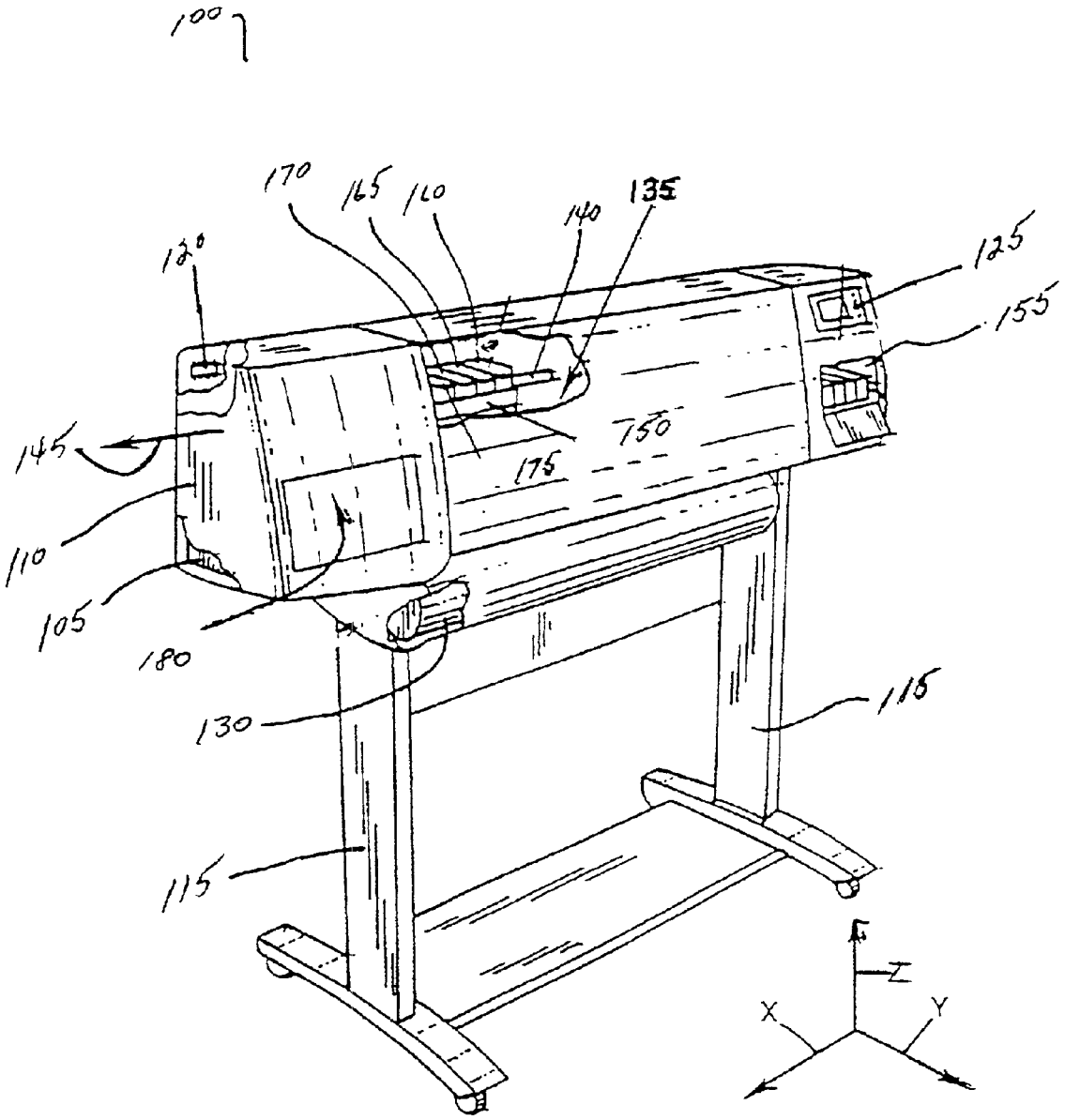
FIG. 1 is a perspective view of a printer in accordance with the invention in cut-away form.

FIG. 1 shows an example of a large format inkjet printer 100, in accordance with the present invention. Large format printers are usually used for printing conventional engineering and architectural drawings as well as high quality poster-sized images, and the like, in an industrial, office, home, or other environment.

Inkjet printing mechanisms are commercially available in many different types of products. For instance, some of the commercially available products that may embody the present invention include desk top printers, portable printing units, copiers, cameras, video printers, facsimile machines, etc.

Printer components may vary from model to model, however, the printer 100 in this example includes chassis 105 surrounded by enclosure 110. Printer 100 may be supported on a desk or tabletop, but preferably includes a pair of leg assemblies 115. Printer 100 also has a controller, illustrated schematically as processor 120, that receives instructions from a host device, typically a computing device, for example, a personal computer, a mainframe, etc. (not shown).

Printer 100 may also include key pad and display panel 125, which provides a user interface where the display provides information to a user and the keypad accepts input from the user. A monitor (not shown) coupled to the host device may also be used to display visual information to an operator, such as printer status, service requirements, error conditions, etc.

A conventional print media handling system (not shown) may be used to advance a continuous sheet of print media 130 through print zone 135. Print media 130 may be any type of suitable sheet material, such as paper, poster board, fabric, transparencies, mylar, etc. Carriage guide rod 140 is mounted to chassis 105 to define scanning axis 145, with carriage guide rod 140 slideably supporting printhead carriage 150 for travel back and forth, reciprocally, across print zone 135. Printhead carriage 150 also travels into servicing area 155. A conventional carriage drive motor (not shown) may be used to propel printhead carriage 150 in response to at least one control signal received from processor 120. Carriage position information is also provided processor 120, for example, using a metallic encoder strip (not shown) which may be extended along the length of print zone 135 and over servicing area 155. An optical encoder reader may be mounted on the back surface of printhead carriage 150 to read positional information provided by the encoder strip, for example, as described in U.S. Pat. No. 5,276,970, also assigned to Hewlett-Packard Company, the assignee of the present invention. The manner of providing positional feedback information may also be accomplished using any number of methods. Upon completion of a print job, printhead carriage 150 may be used to drag a cutting mechanism across the final trailing portion of print media 130 to sever the printed portion of print media 130 from the remainder of the continuous sheet. Moreover, printer 100 may also be capable of printing on precut sheets, rather than on continuous sheet print media 130.

In print zone 135, ink is applied to print media 130 from at least one printhead, for example, black ink printhead 160 and three monochrome color ink printheads 165, 170, 175. It should be understood that printheads 160, 165, 170, 175 may contain dye based inks, pigment based inks, paraffin based inks, hybrid inks having both dye and pigment characteristics, and/or any other type of ink suitable for printing applications. In a this example printer 100 uses an "off axis" ink delivery system, having main reservoirs (not shown) for each ink (e.g., black, cyan, magenta, yellow, etc.) located in ink supply section 180. In this off axis system, printheads (160, 165, 170, 175) may be replenished by ink conveyed through a conventional flexible tubing system (not shown) from stationary main reservoirs, so only a small amount of ink is propelled by printhead carriage 150 across print zone 135 which is located "off axis" from the path of printhead travel.

Figure 2:
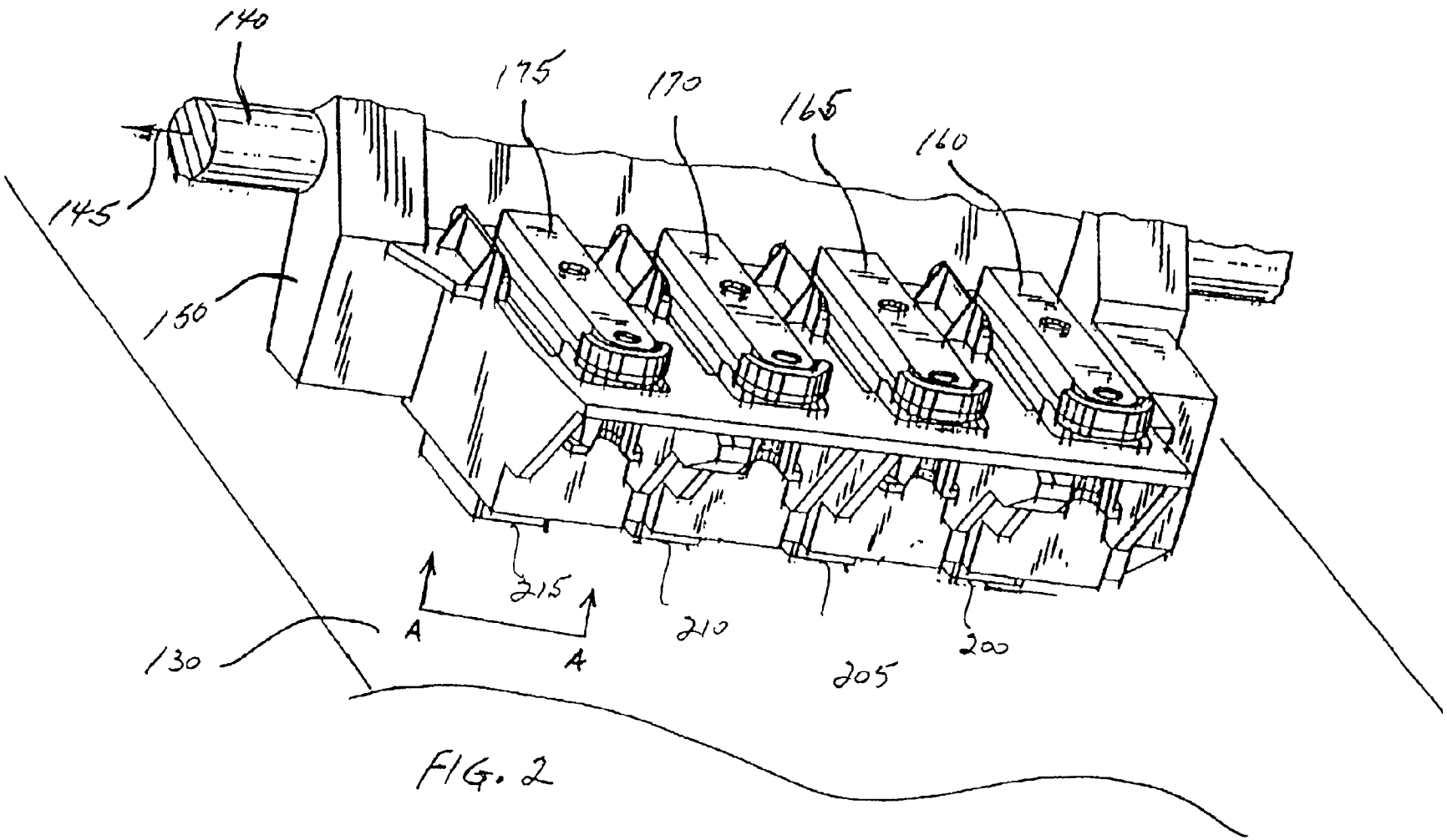
FIG. 2 is a perspective view of a printhead carriage assembly.
Figure 3:
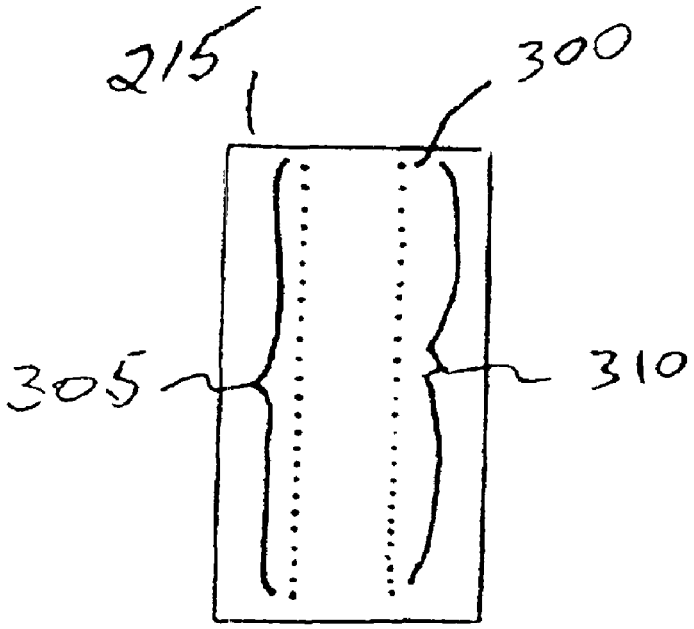
FIG. 3 is a diagram of a printhead showing the placement of nozzles on a nozzle plate.

FIG. 2 shows printhead carriage 150 slideably supported by carriage guide rod 140. Printheads (160,165, 170, 175) are positioned in printhead carriage 150 above a portion of print media 130. Printheads (160, 165, 170, 175) each have a nozzle plate (200, 205, 210, 215) respectively through which ink is ejected onto print media 130. FIG. 3 shows a view of example nozzle plate 215 from a view designated by arrows "A" in FIG. 2. Nozzle plate 215 includes a plurality of nozzles 300. Nozzles 300 of nozzle plate 215 are typically formed in at least one, but more typically two or more linear arrays 305, 310 on the face of nozzle plate 215. Each linear array is typically aligned in a longitudinal direction substantially perpendicular to the printing axis 145, with the length of each array determining the maximum image swath for a single pass of a printhead.

Figure 4:
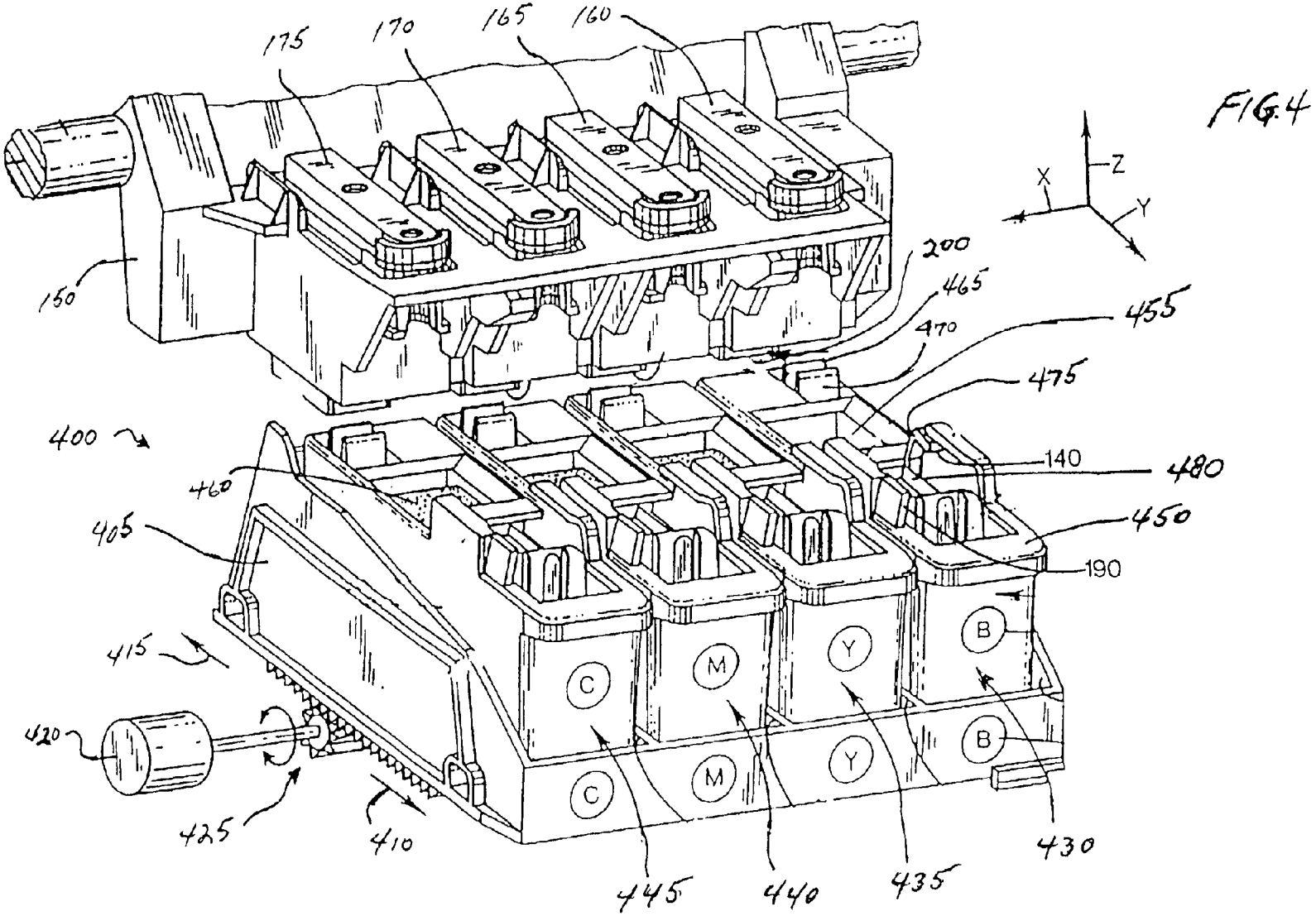
FIG. 4 shows a printhead carriage positioned above a printhead service station.

In order to perform service procedures on a printhead, a printhead service station 400, an example of which is shown in FIG. 4 may be used. In FIG. 4, printhead carriage 150 is shown positioned above printhead service station 400, located in servicing area 155 (FIG. 1) with printheads (160, 165, 170, 175) situated such that recovery procedures may be performed. Printhead service station 400 includes a translationally moveable service station pallet 405, which may be driven in both a forward direction 410 and a rearward direction 415. An example of a suitable driving mechanism for printhead service station 400 may include motor 420 coupled to rack and pinion gear assembly 425. Motor 420 may drive the rack and pinion gear assembly in response to a drive signal received from the processor 120. Printhead service station 400 may include a number of print head cleaner units (430, 435, 440, 445) corresponding to the number of printheads (160, 165, 170, 175). Because each printhead cleaner unit (430, 435, 440, 445) has substantially the same construction, printhead cleaner unit 430 will be described in detail, but it should be understood that the description also applies to printhead cleaner units (435, 440, 445). Printhead cleaner unit 430 preferably include an installation and removal handle 450, which may be gripped by an operator when installing printhead cleaner unit 430 in service station pallet 405. Printhead cleaner unit 430 also includes spittoon chamber 455. Spittoon chamber 455 may be filled with an ink absorber 460, preferably a foam material, although any suitable absorbing material may be used. Ink absorber 460 receives ink spit from printhead 160 and holds the ink while the volatiles or liquid components evaporate, leaving the solid components of the ink trapped within the chambers of the foam material. In an alternate embodiment, spittoon chamber 455 may be supplied as an empty chamber, which then fills with a tar like ink residue over the life of printhead cleaner unit 430.

Printhead cleaner unit 430 may include a dual bladed wiper assembly which has two wiper blades (465, 470) which are preferably constructed with rounded exterior wiping edges, and an angular interior wiping edge. Printhead cleaner unit 430 may optionally include an ink solvent chamber (not shown) which holds an ink solvent. To deliver the solvent from the ink solvent chamber to printhead 160, printhead cleaner unit 430 may includes a solvent applicator 475.

Printhead cleaner unit 430 may also include a cap member 480 which can move in the Z axis direction, while also being able to tilt between the X and Y axes, which aids in sealing printhead 160. The cap member 480 preferably has an upper surface which may define a series of channels or troughs, to act as a vent path to prevent depriming printhead 160 upon sealing.

Thus, by movement of the printhead service station 400, cap member 480 may seal printhead 160 from the immediate environment. By movement of the printhead service station in forward direction 410 spittoon chamber 455 can be positioned to receive ink ejected from printhead 160. By further movement in forward direction 410 wiper blades (465, 470) can be made to wipe nozzle plate 200. These movements may be included as part of one or more service procedures described herein.

Figure 5:
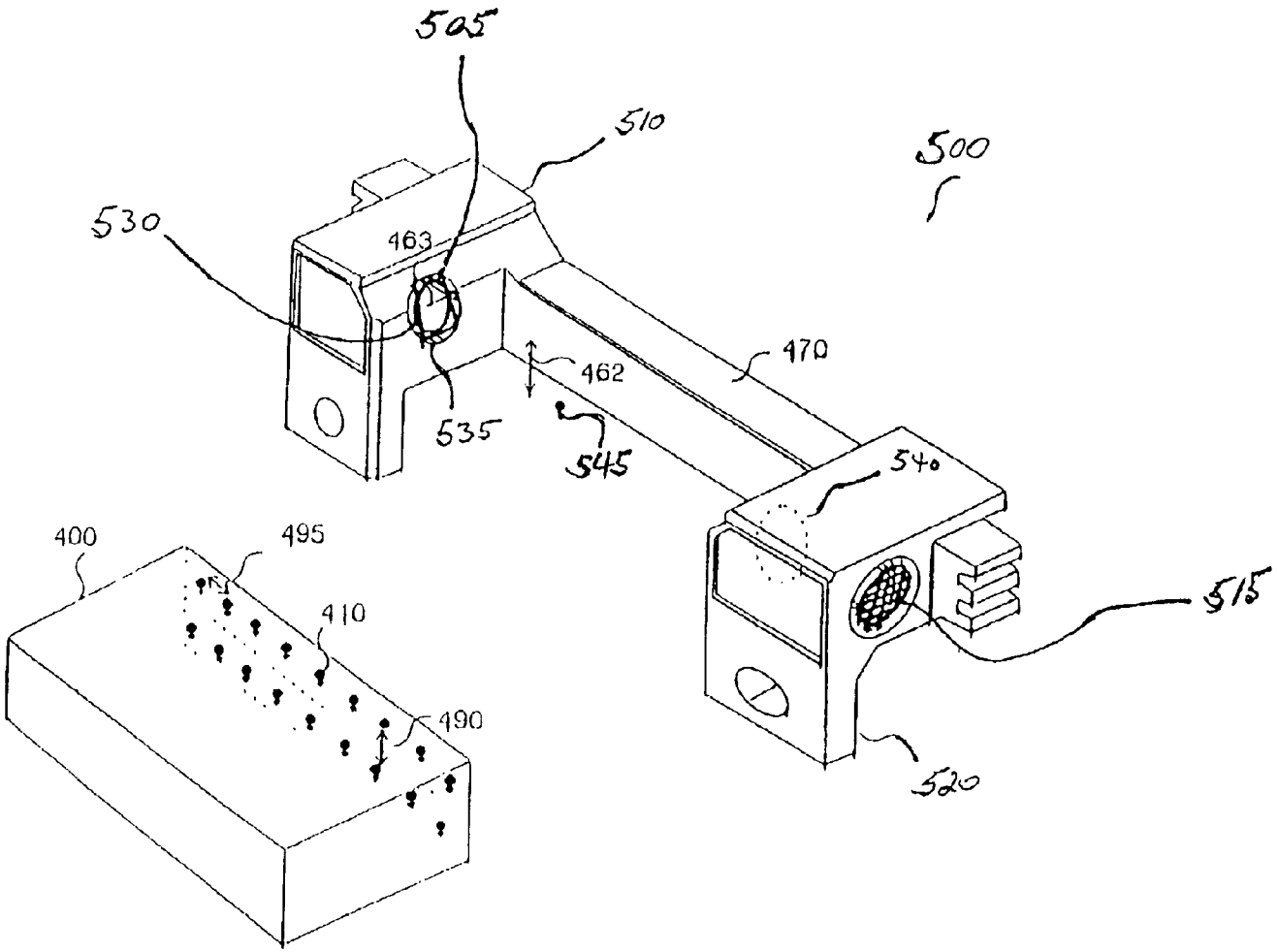
FIG. 5 illustrates a drop detection device.

Various devices may be used to determine the health of the nozzles of printheads (160, 165, 170, 175) in order to determine whether servicing procedures are required. An example of such a device is drop detection device 500 as shown in FIG. 5. Emitter 505 is mounted in emitter housing 510 and detector 515 is mounted in detector housing 520. An elongate, substantially straight, substantially rigid member 525 connects the two housings (510, 520). Emitter housing 510, member 525 and detector housing 520 all comprise a substantially rigid assembly configured to actively locate emitter 505 with respect to detector 515.

Drop detection device 500 is oriented such a path traced by an ink droplet from any one of printheads (160,165, 170, 175) passes between emitter 505 and detector 510. Collimator 530 is provided either as part of emitter 505 or as a separate item so as to collimate radiation emitted by emitter 505 into a radiation beam which exits emitter housing 510 via emitter aperture 535. The collimated radiation beam is admitted into detector housing 520 by way of detector aperture 540 and impinges on detector 515. An ink droplet 480 sprayed from a nozzle on any of the printheads (160, 165, 170,175) enters the collimated radiation beam and causes a change in the beam impinging on detector 515 and thus in the output of detector 515.

Various techniques may be employed to detect ink droplets and their paths using the drop detection device 500. These may include, for example, spraying a specific number of ink drops from individual nozzles in turn in specific timing sequences to account for the speed of the drops, accounting for the distance between the nozzle and the radiation beam, using the output of the detector 515 to determine the time the drop spends in the radiation beam, and/or to determine the path the ink droplet navigates, etc. From these various operations and calculations an assessment of the health of the nozzles in printheads (160, 165, 170, 175) may be determined.

The drop detector may also be embodied as a "print on media and scan" type drop detector, where a pattern is printed on the media and then scanned to determine various parameters of the pattern. By utilizing the various parameters of the printed pattern the processor 120 may then determine the health the individual nozzles of each of the printheads (160, 165, 170, 175).

It is important to note that the ink drop detection device is at least able to provide information to the processor 120, allowing the processor to determine parameters related to the health of each nozzle. These parameters may include any parameter suitable for determining the functionality of the nozzle.

Figure 6:
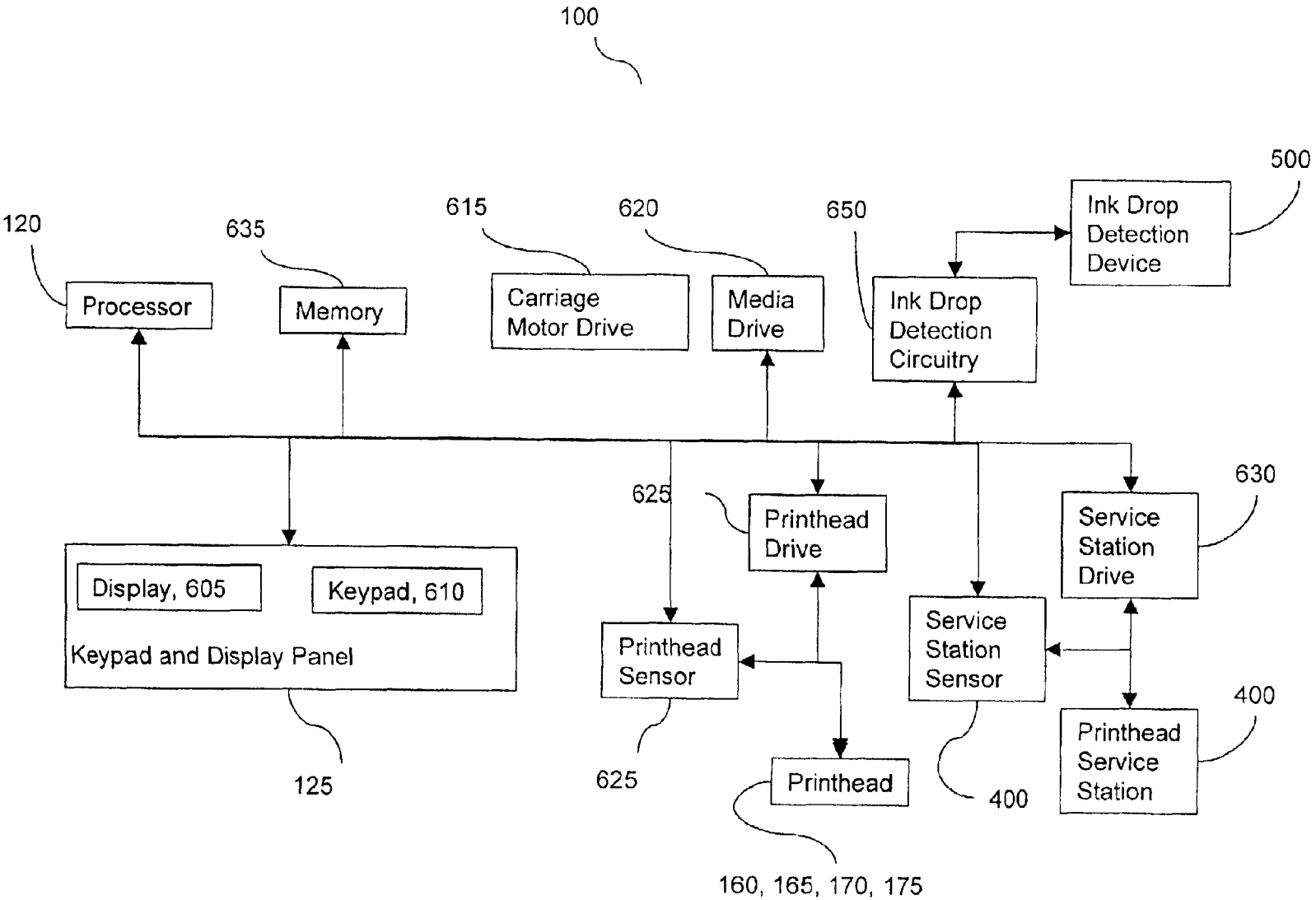
FIG. 6 illustrates schematically a block diagram of the printer.

FIG. 6 shows a block diagram of printer 100. Printer 100 includes processor 120 for directing printer operations and keypad and display panel 125 including display 605 and keypad 610 for displaying messages to a user and receiving user inputs, respectively. Printer 100 also includes carriage motor drive 615 for positioning the printhead carriage 150, media drive 620 that operates to position the print media 130, and printhead drive circuitry 625 for controlling the individual nozzles on each printhead (160, 165, 170, 175). Printer 100 also includes service station drive 630 for positioning printhead service station 400, and system memory 635 for storing programs, including a printer operating system, temporary system operating parameters and temporary data.

Processor 120 executes programs in memory 635 either automatically, in response to user inputs from keypad and display panel 125, or in response to inputs from the host device. As a part of executing these programs, processor 120 receives printing instructions grouped together known as a print job from the host device. Additionally, the programs executed by processor 120 may include routines for checking the status of various printer components at power up, receiving print jobs, and performing various recovery actions as described below.

The printer 20 also includes sensors for determining the status of certain components. A printhead sensor 640 may record various aspects of the printheads (160,165,170, 175) including electrical continuity and power supply voltages. A service station sensor 645 may be used to determine if a spittoon, present as part of a particular printhead cleaner unit (430 435 440 445) is full.

Figure 7:
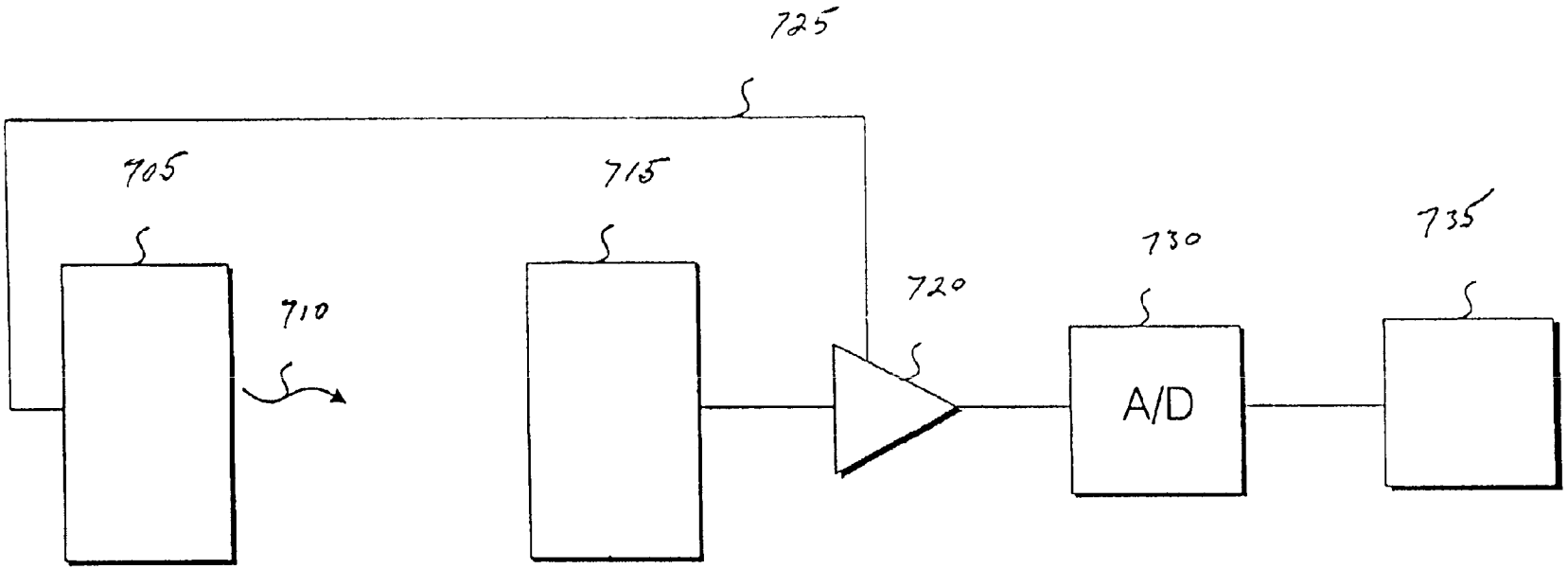
FIG. 7 shows a block diagram of the functional blocks of the drop detection system.

The printer 100 may also include drop detection circuitry 650 coupled to drop detection device 500. An example of drop detection circuitry 650 is shown in more detail in FIG. 7. Emitter driving circuitry 705 applies a signal to emitter 505 causing it to emit a radiation beam 710 which impinges on detector 515. Detector circuitry 715 may condition the output of detector 515 which is then coupled to amplifier 720. Amplifier 720 is configured to increase a signal to emitter driving circuitry 705 in response to a decrease in an output of detector circuitry 715 and to decrease a signal to emitter driving circuitry 705 in response to an increase in an output of detector circuitry 715 via signal path 725. An amplified output of amplifier 720 is then coupled to analog to digital (A/D) converter 730. A/D converter 730 samples and digitizes the amplified output of amplifier 720. Preferably, the A/D converter 520 samples the amplified output current 64 times with a sampling frequency of 40 kilohertz. The period between samples is, preferably, 25 $\mu$s yielding a total sampling time of 1.6 milliseconds. The samples of the output of the amplified output of amplifier 720 are stored and processed by drop detection processor 735. Drop detection processor 735 processes the samples to determine whether or not an ink droplet has crossed the radiation beam 710, and to analyze the characteristics of a particular nozzle based on the sampled output. Drop detection processor 735 may also store an indication of the health of each nozzle of the plurality of nozzles comprising each printhead (160, 165, 170,175). For example, drop detection processor 735 may store an indication that a nozzle is fully functional, not ejecting ink at all (a "nozzle out" condition), firing off axis or sideways, or ejecting a smaller volume of ink than expected. Drop detection processor 735 may also record the results of each drop detection performed for each nozzle, thus storing a nozzle health history for each nozzle. Information stored by drop detection processor 735 may be stored in a memory present in drop detector 735, in system memory 635, or in any other memory suitable for storing such data. Nozzle health may be determined before starting a print job, after completing a print job, or after a service procedure.

The service procedures discusses thus far are performed as a corrective or remedial action, for example, to cure a nozzle out failure. Service procedures may also be scheduled as part of a maintenance program. Maintenance service procedures are typically performed as a preventative measure to avoid future printhead failures. As an example of a maintenance service procedure, in the event that printhead 160 remains idle and uncapped for a predetermined period of time, a wipe procedure may be implemented, a nozzle health check performed, and if all nozzles are functioning adequately, the printhead may be capped. Other conditions that may trigger a maintenance operation include: a particular nozzle has not been fired for a particular period of time; a number of nozzles have fired less than a predetermined number of drops over a particular time period; a nozzle is firing off axis or sideways, or is ejecting a smaller volume of ink than expected.

In accordance with the invention, in the event that service is required for a printhead, a calculation of the age of the printhead is performed, and service procedures are selected based on the printhead's calculated age. In the following, exemplary age calculations and selection of service procedures will be described with respect to printhead 160, however, it should be understood that the same process may be performed on all printheads (160,165, 170,175) in printer 100.

The age of printhead 160 may be expressed in a number of ways. For purposes of this invention we will discuss the age of printhead 160 in terms of the percentage of its life that has been consumed. For example, an unused printhead will have an age of 0% while a printhead that is at the end of its useful life will have an age of 100%. The age of printhead 160 may be further classified in phases. For example, when just installed, printhead 160 may be referred to as being at the beginning of life phase. When printhead 160 is at the middle of its design life, it may be referred to as being at the middle of life phase, while when printhead 160 is in the latter stages of use, it may be referred to as being at the maturity, or end of life phase. The intervals of each of these phases may vary depending on the type of printhead and the type of printer in which it may be used. Some example ranges of phase intervals are shown in Table 1.

TABLE 1

| | |
|---|---|
| 0%–>20% | Beginning of life |
| 20%–90% | Middle of life |
| >90% | Maturity, End of Life |

The age of a printhead may be determined from various factors. In the simplest form, the age of a printhead may be determined from the volume of ink expelled from the printhead. The design life of a printhead is frequently stated in terms of cubic centimeters (cc's) of ink expelled. For example, in a large format printer, a printhead may have a design life of 2000 cc's. Using the intervals from Table 1 above, a printhead of this type would be considered at the beginning of its life while it has expelled less than 400 cc's of ink. The printhead is considered to be in the middle of its life when it has expelled between 400 and 1800 cc's of ink, and at the end of its life when it has expelled more than 1800 cc's of ink.

Other factors may also be considered when calculating the age of a printhead. For example, time may be a factor used to calculate the age of a printhead. In some cases an ink may have a shelf life beyond which it may be unusable, and as a result, time measured from the date of manufacture may be utilized when calculating printhead age, regardless of an amount of use. Other components of the printhead, such as seals or gaskets, may also degrade over time. As another example, the time that a printhead has been idle may have a negative impact on its age. For example, a printhead that has been unused for an extended period may have dried ink on its nozzle plate which may have to be cleared.

Other factors that may be used to calculate the age of a printhead are the number and/or types of failures previously experienced by the printhead. For example, a number of previous failures above a particular threshold may be used as a factor to increase the calculated age, while a number of failures below a particular threshold may be used to decrease the calculated age of a printhead. Correspondingly, a nozzle spitting less than an expected volume may be weighted differently in the age calculation than a nozzle out failure.

Another factor for calculating printhead age, related to the number and types of failures, includes the number and/or types of service procedures previously performed on a particular printhead. For example, as mentioned above, prolonged wiping of the nozzle plate may result in distortion and/or excessive wear. Also, excessive ink drop ejection may cause nozzle wear and/or premature heater element failure.

Another factor is the number of print jobs, or plots, the printhead has printed. Upon starting a new print job, the printer may perform initialization procedures, such as spitting, wiping, priming, etc., that may affect the age calculation of a printhead.

It should be understood that any combination of the factors described above may be used to calculate the age of the printhead. Other factors may also be used either alternatively or in combination with any of the aforementioned factors in calculating the age of the printhead. The other factors may include those related to printer 100, print media 130, ink type, or any other factor suitable for calculating the age of the printhead.

Once the age of a printhead has been determined, service procedures are selected for curing a failure based on the calculated age of the printhead. The service procedures may be selected from any number or type of service procedures, however, it should be understood that the service procedures are selected such that the intensity and frequency of the service procedures increase corresponding to the age of the printhead. One exemplary service procedure having a low intensity could be a spit procedure, where selected nozzles of the printhead are directed to eject a certain number of drops. An example of a more intense service procedure could be a wipe procedure, where selected nozzles eject a number of drops, a wiping action is performed on the printhead, and then the selected nozzles again eject a number of drops. An example of an even more intense service procedure is a priming procedure, where ink is forced through the chambers and passageways of the printhead and air or other gas bubbles are purged from the printhead.

It has been determined empirically that when a printhead is at the beginning of life that no service at all, or service procedures of low intensity, are likely to cure nozzle health problems. Correspondingly, it has been determined that as the calculated age of a printhead increases, more intense servicing including combinations of various actions are usually required to cure nozzle health problems. Therefore, selecting procedures of lower intensity for a printhead at the beginning of life, and of increasing intensity as the printhead ages is advantageous because printhead life may be extended. This is because service procedures that have a more negative impact on printhead life are performed more often at the later stages of a printhead's life, when long term life is less of a concern. It should be understood that in the event that the service procedures selected in accordance with the printhead age fail to cure the printhead problem, subsequent service procedures may be invoked with increased frequency and/or more intense service procedures in order to cure the problem, or printer 100 may provide a message to the operator requesting some type of operator intervention.

Figure 8:
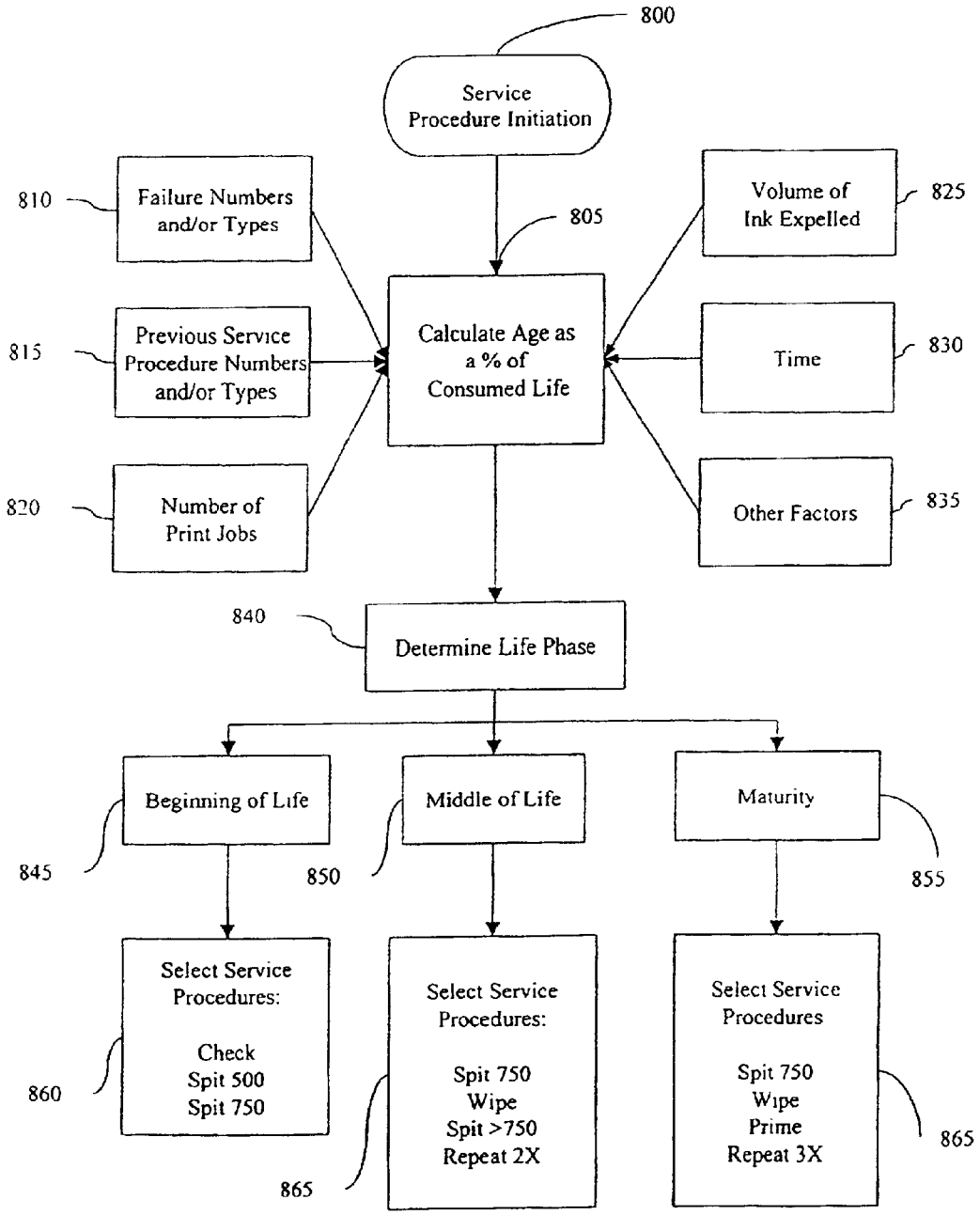
FIG. 8 shows a flow diagram of an example of the operation of a printer in initiating servicing procedures in accordance with the teachings of this invention.

Referring now to FIG. 8, an example of the initiation of servicing procedures will be described in greater detail. At step 800, the initiation of a service procedure for a printhead begins. It is assumed that processor 120 has initiated a service procedure based on some requirement, for example, an indication of nozzle health or a determination that a maintenance service procedure is required. Upon initiation of the service procedure, the age of the printhead is calculated in step 805. Any combination of the factors (810, 815, 820, 825, 830, 835) may be used in the calculation. The age of the printhead is expressed as a percentage of life that has been consumed. A simple example of an age calculation may be of the form:

$$L=(V_E/V_D)*100$$

Where L represents the percentage of the consumed life of the printhead, $V_E$ represents the volume of ink expelled by the printhead as illustrated in step 825, and $V_D$ represents the design life of the printhead expressed as a total volume of ink expelled. Another example of the age calculation make take the form:

$$L=(V_E/V_D)*100)/(F*S)$$

Where F represents a scaled weighting factor reflecting the number of previous failures of the printhead as illustrated in step 810, and S represents a scaled weighting factor reflecting the number of previous service procedures performed on the printhead as illustrated in step 815.

As a result of the age calculation, in step 840 a determination is made as to the life phase of the printhead. Using Table 1 above, if the age calculation determines that less than 20% of the printhead life has been consumed, the printhead is considered to be in the beginning of life phase (step 845). If the percentage of life consumed is between 20% and 90% inclusive, the printhead is considered to be in the middle of life phase (step 850), and if the percentage of life consumed is greater than 90% the printhead is at the maturity phase (855). After the printhead life phase has been determined, a set of service procedures are selected based on the life phase. Example sets of service procedures selected based on the phase of the printhead are shown in steps 860, 865, and 870.

In step 860, the printhead is considered to be in the beginning of life phase, and so the procedures selected are relatively low in intensity, that is, they have a relatively low impact on printhead life, and have a low frequency of repetition. In this example, they are performed only once.

In step 865, the printhead age calculation has determined that the printhead is in the middle of life phase. Therefore the procedures selected are moderate in intensity and on the long term life of the printhead, and have a correspondingly moderate frequency of repetition. In this example, they are repeated a maximum of two times.

Step 870 shows example service procedures chosen when a printhead is in the maturity stage of life. The procedures progress to those having a significant impact on printhead life and a higher repetition rate than those selected for other phases of printhead life. In this example, the selected procedures may be repeated up to three times.

Figure 9:
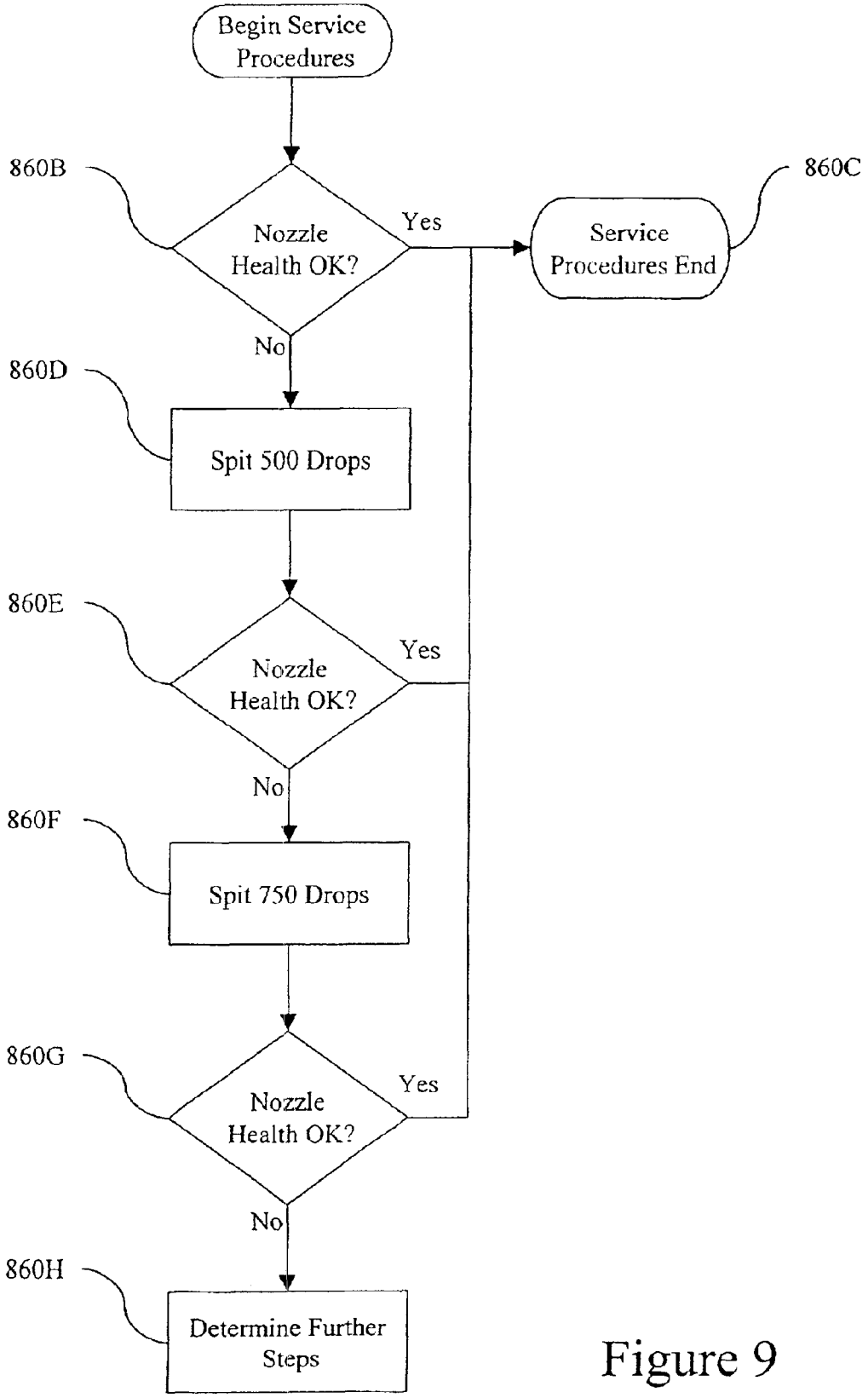
FIGS. 9, 10 and 11 show flow diagrams of service procedures having different intensities and rates of repetition based on a calculated age of a printhead.

Turning now to FIG. 9, the performance of the selected service procedures shown in step 860 will now be described. Because the printhead is at the beginning of its life, the initial servicing action is to simply perform another nozzle health check as shown in step 860B. As mentioned above, it has been determined empirically that for a printhead at this phase, no servicing may be required. In the event that the subsequent nozzle health check shows that the printhead is operating in an adequate manner, the service procedure ends (step 860C). In the event that the subsequent nozzle health check shows that a problem continues to exist, a spit procedure (860D) may be implemented. As an example, processor 120 may direct the failing nozzles of printhead 160 to spit 500 drops at a frequency of 6 kHz, and then direct all nozzles of printhead 160 to spit 4 drops at the same frequency. A nozzle health check is again performed at step 860E. In the event that printhead 160 is now operating adequately, the service procedure ends at step 860C. In the event that the subsequent nozzle health check shows that a problem continues to exist, the processor 120 may instruct the failing nozzles to spit 750 drops at 6 kHz (step 860F) and then all nozzles to spit 20 drops at 10 kHz. An additional nozzle check is then performed. If the nozzle failures have not yet been cured, processor 120 may have to determine further actions that may be required as shown in step 860H. These could include notifying the operator, selecting another set of service procedures, or other actions for remedying the problem.

Figure 10:
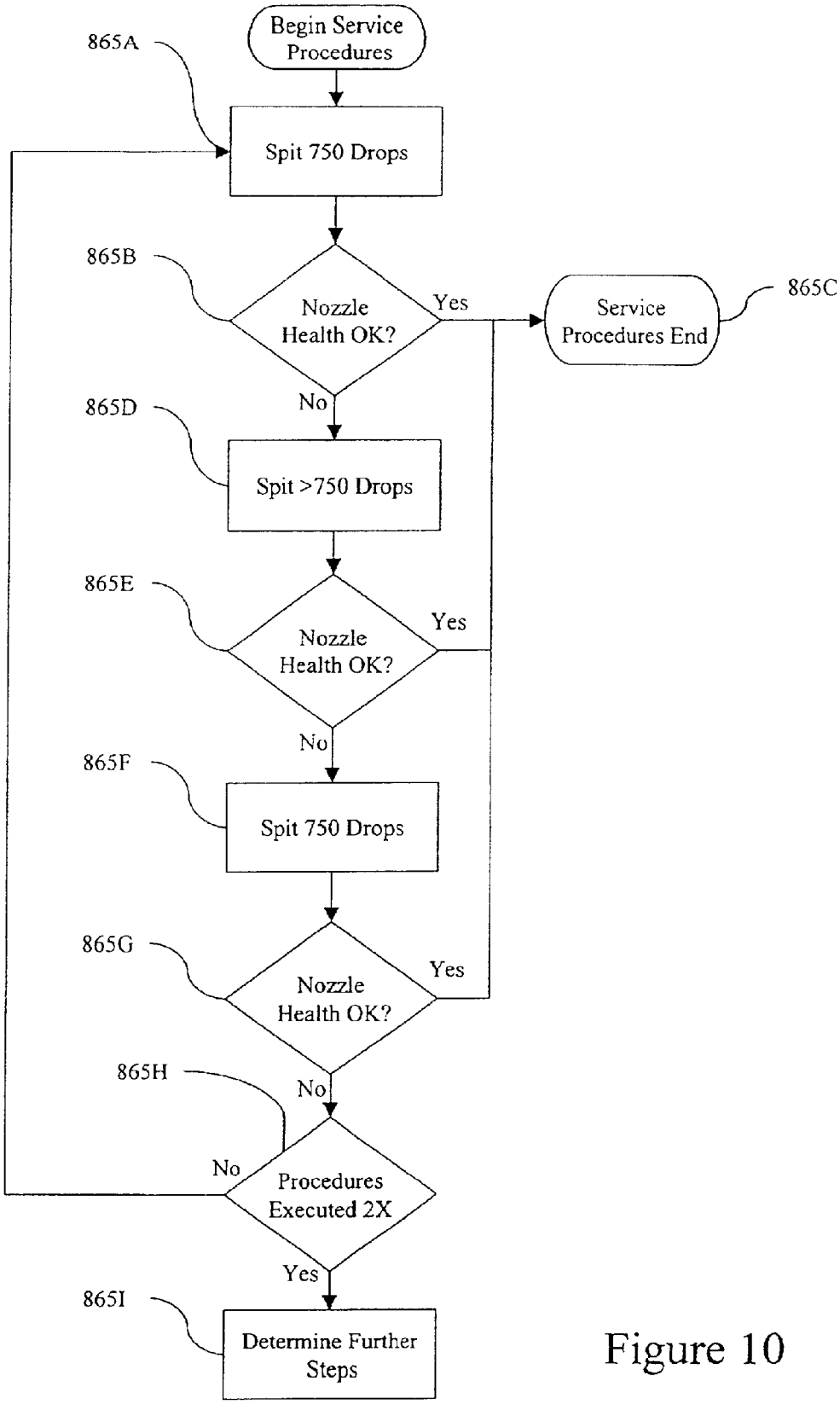

Turning now to FIG. 10, the performance of the selected service procedures in step 865 will now be described. In step 865, printhead 160 in the middle of life phase, and so the procedures selected begin with those of are of low intensity and progress to those having a moderate intensity, that is, they have a measurable, but not excessive, impact on printhead life. The procedures may have a moderate frequency of repetition, for example, in this selected set of procedures they are repeated a maximum of two times. The initial servicing action is a spit procedure (step 865A), where the failing nozzles are directed to spit 750 drops, an example of which has been described above. A nozzle health check is performed as shown in step 865B. In the event that the nozzle health check shows that printhead 160 is operating in an adequate manner, the service procedure ends (step 865C). In the event that the nozzle health check shows that a problem continues to exist, a wipe procedure (865D) may be executed. The wipe procedure may include the processor 120 directing the printhead service station 400 to move in a forward direction 410 and a backward direction 415 so that wiper blades (456, 470) wipe across nozzle plate 200. A nozzle health check is again performed at step 865E. In the event that printhead 160 is now operating adequately, the service procedure ends at step 865C. If the subsequent nozzle health check shows that a problem continues to exist, an additional spit procedure may be implemented (step 865F) where failing nozzles spit a larger number of drops than the spit procedure of step 865A.

At the end of the additional spit procedure (865F) another nozzle health detection check is implemented (step 865G). If printhead 160 is operating satisfactorily, the service procedure ends at step 865C. If the nozzle failures have not yet been cured, a test is done to determine if the entire servicing procedure has been performed twice (step 865H). If not, the service procedure returns to step 865A and is performed again. If the service procedure has been performed twice, and printhead 160 continues to exhibit unsatisfactory performance, processor 120 may have to execute additional measures as shown in step 8651. These could include selecting and performing additional service procedures, notifying the operator, or other measures for remedying the problem.

Figure 11:
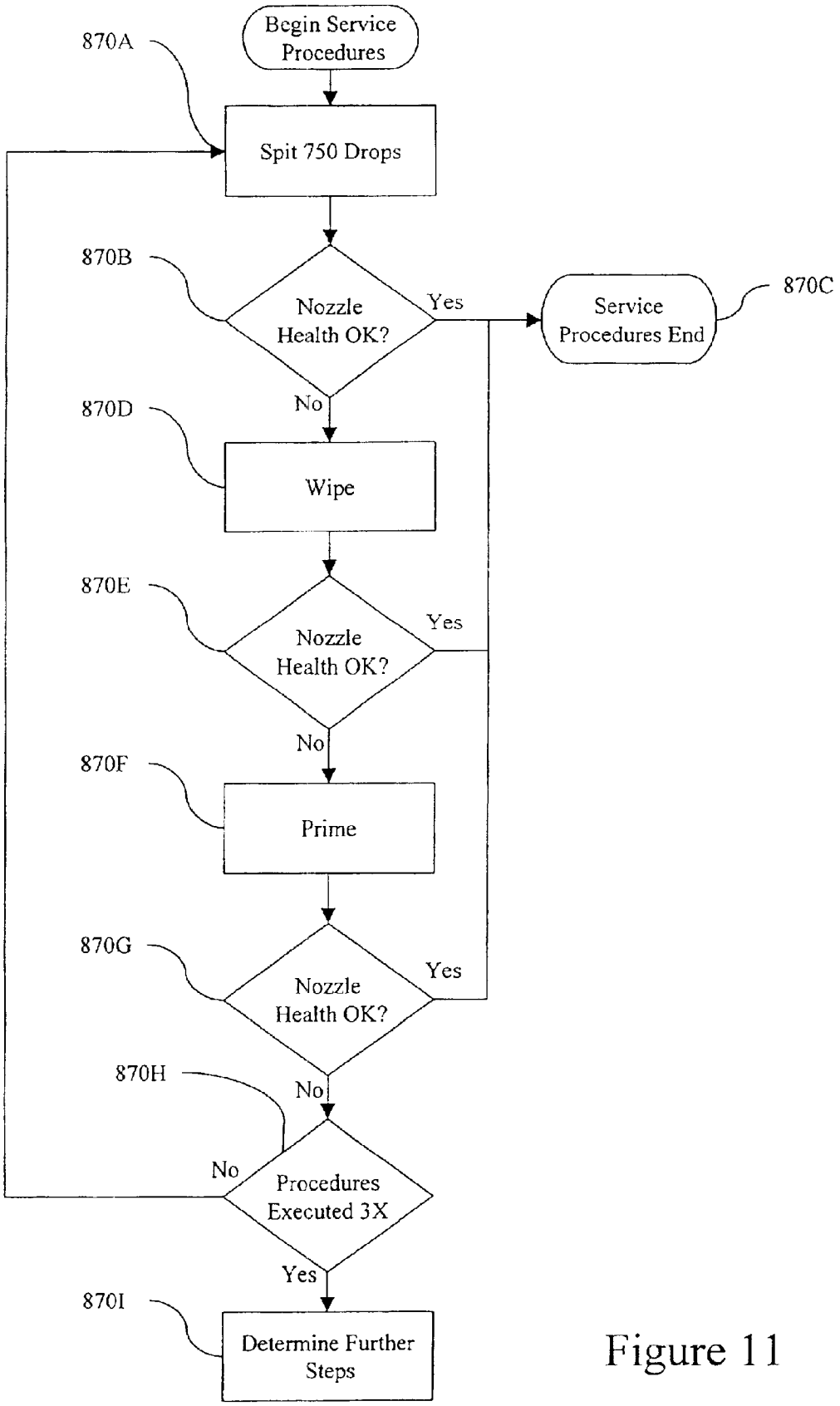

FIG. 11 shows the service procedures selected in step 870, where the printhead 160 in the maturity life phase. The selected procedures begin with those having a low impact on printhead life and progress to those having a severe impact on printhead life. The procedures may also have a higher frequency of repetition. In this example, the procedures are repeated three times. The initial servicing action is a spit procedure (step 870A), where each failing nozzle is directed to spit 750 drops and all nozzles are then directed to spit 20 drops. A nozzle health check is performed as shown in step 870B. In the event that the nozzle health check shows that printhead 160 is operating in an adequate manner, the service procedure ends as shown in step 870C. In the event that the nozzle health check shows that a problem continues to exist, a wipe procedure (870D) as previously described may be executed. A nozzle health check is again performed at step 870E. In the event that printhead 160 is now operating adequately, the service procedure ends at step 870C. If the subsequent nozzle health check shows that a problem continues to exist, a priming procedure may be implemented (step 870F). At the end of the priming procedure (870F) another nozzle health detection check is implemented (step 870G). If printhead 160 is operating satisfactorily, then the service procedure ends at step 870C.

If the nozzle failures have not yet been cured, a test is done to determine if the servicing procedure has been performed three times (step 870H). If not, the service procedure returns to step 870A and is performed again. If the service procedure has been performed three times, and printhead 160 continues to exhibit unsatisfactory performance, processor 120 may have to execute additional measures as shown in step 870I. These could include selecting and performing additional service procedures, notifying the operator, or other measures for remedying the problem.

In summary, the printer determines if a service procedure is required in order to maintain print quality. In the even that a service procedure is required, the relative age of the printhead being serviced is calculated, and service procedures and repetition rates that are appropriate for the printhead, based on its age are selected and performed. In the event that the selected procedures do not result in adequate performance of the printhead, other measures may be taken to correct any problems.

It should be understood that the actual age calculations and determinations of life phase may include factors and criteria other than those mentioned in the examples above, so long as they are suitable for determining an age of a printhead and appropriate service procedures in accordance with the present invention.

It can thus be appreciated that while the invention has been particularly shown and described with respect to preferred embodiments thereof, it will be understood by those skilled in the art that changes in form and details may be made therein without departing from the scope and spirit of the invention.

We claim:

1. A method of determining service criteria for a printhead in a printer comprising:

receiving an indication that service is needed;

determining a calculated age of said printhead; and selecting a service procedure based on the determined calculated age.

2. The method of claim 1, wherein said selected service procedure has an impact on the long term life of said printhead that is proportional to the calculated age.

3. The method of claim 1, further comprising classifying said calculated age as one of a plurality of phases.

4. The method of claim 3, wherein said plurality of phases include at least a beginning of life phase and a maturity phase.

5. The method of claim 3, wherein said plurality of phases include at least a beginning of life phase, a middle of life phase and a maturity phase.

6. The method of claim 5, wherein said selected service procedure for said beginning of life phase has a low impact on the long term life of said printhead.

7. The method of claim 5, wherein said selected service procedure for said middle of life phase has a moderate impact on the long term life of said printhead.

8. The method of claim 5, wherein said selected service procedure for said maturity phase has a severe impact on the long term life of said printhead.

9. The method of claim 1, wherein determining said calculated age comprises utilizing at least one factor selected from the group consisting of: volume of ink expelled, type of previous service procedures, number of previous service procedures, types of previous failures, number of previous failures, time and number of print jobs printed.

10. The method of claim 1, wherein said service procedure has a prolonging impact on the useful life of said printhead.

11. The method of claim 1, wherein said selected procedure services nozzles of said printhead that are selected based on a failed health thereof, then checks the health of said selected nozzles and repeats said selected service procedure if said printhead is determined to be operating inadequately.

12. The method of claim 1, wherein said service procedure is selected from a plurality of service procedures for curing a failure based on said calculated age.

13. The method of claim 1, wherein said service procedure is selected from a plurality of service procedures such that an intensity and a frequency of said service procedures increase corresponding to said calculated age.

14. An apparatus for determining service criteria for a printhead in a printer comprising:

circuitry for receiving an indication that service is needed; and a processor for determining a calculated age of said printhead and selecting a service procedure based on the determined calculated age.

15. The apparatus of claim 14, wherein said selected service procedure has an impact on the long term life of said printhead that is proportional to said calculated age.

16. The apparatus of claim 14, further comprising circuitry for classifying said calculated age as one of a plurality of phases.

17. The apparatus of claim 16, wherein said plurality of phases include at least a beginning of life phase and a maturity phase.

18. The apparatus of claim 16, wherein said plurality of phases include at least a beginning of life phase, a middle of life phase and a maturity phase.

19. The apparatus of claim 18, wherein said selected service procedure for said beginning of life phase has a low impact on the long term life of said printhead.

20. The apparatus of claim 18, wherein said selected service procedure for said middle of life phase has a moderate impact on the long term life of said printhead.

21. The apparatus of claim 18, wherein said selected service procedure for said maturity phase has a severe impact on the long term life of said printhead.

22. The apparatus of claim 14, wherein said processor for determining said calculated age comprises utilizing at least one factor selected from the group consisting of: volume of ink expelled, type of previous service procedures, number of previous service procedures, types of previous failures, number of previous failures, time and number of print jobs printed.

23. The apparatus of claim 14, wherein said service procedure has a prolonging impact on the useful life of said printhead.

* * * * *